United States Patent [19]

Wachenheim

[11] Patent Number: 4,807,315

[45] Date of Patent: Feb. 28, 1989

[54] WATERBED PEDESTAL WITH SAFE

[76] Inventor: John E. Wachenheim, 1729 E. Clay, Decatur, Ill. 62521

[21] Appl. No.: 126,181

[22] Filed: Nov. 27, 1987

[51] Int. Cl.[4] ..... A47C 19/22

[52] U.S. Cl. ..... 5/400; 5/2 R; 5/308; 109/23; 109/50; 109/68; 312/204

[58] Field of Search ..... 5/308, 58, 2 R, 400, 5/451, 452; 312/204; 109/68, 50, 51, 52, 23

[56] References Cited

U.S. PATENT DOCUMENTS

| | | | |
|---|---|---|---|
| 331,163 | 11/1885 | Shannon | 312/204 |
| 795,155 | 7/1905 | Nees | 5/308 |
| 1,480,853 | 1/1924 | Diamond | 5/308 |
| 1,509,285 | 9/1924 | Colbow, Jr. | 312/204 |
| 2,895,145 | 7/1959 | Soifer | 5/308 |
| 3,140,134 | 7/1964 | Nairn | 312/204 |
| 4,110,854 | 9/1978 | Sjolie | 5/2 R |
| 4,613,999 | 9/1986 | Franco et al. | 5/400 |

FOREIGN PATENT DOCUMENTS

| | | | |
|---|---|---|---|
| 440458 | 2/1927 | Fed. Rep. of Germany | 5/308 |

*Primary Examiner*—Alexander Grosz

*Attorney, Agent, or Firm*—Senniger, Powers, Leavitt and Roedel

[57] ABSTRACT

A waterbed pedestal for supporting a waterbed frame and mattress on its top surface, the pedestal of the type comprising a plurality of panels assembled to form head, foot, and left and right side faces. The pedestal includes a cavity that is positioned to extend underneath a waterbed mattress so that the mattress covers the top of the cavity, and that opens at its front in one of the faces of the pedestal. A safe is positioned in the cavity and secured to the pedestal. A removable panel is positioned over the front of the cavity to close the cavity and hide the safe.

19 Claims, 4 Drawing Sheets

WATERBED PEDESTAL WITH SAFE

BACKGROUND OF THE INVENTION

This invention relates to waterbeds, and in particular to pedestals for supporting a waterbed frame and mattress.

Waterbeds typically comprise a pedestal base supporting a frame on its top surface, and a large plastic water-filled bladder supported by the frame over the pedestal. Various types of drawers, shelves, and cabinets have been incorporated into waterbed pedestals for storage. However these storage devices have all been visible and easily accessible, and thus unsuitable for storing and protecting valuables.

SUMMARY OF THE INVENTION

It is among the objects of this invention to provide a waterbed pedestal that provides for storing and protecting valuables; it is therefore among the objects of the present invention to provide a waterbed pedestal incorporating a safe. It is further among the objects of the present invention to provide such a waterbed pedestal in which the safe is hidden to enhance appearance and improve security. It is also among the objects of the present invention to provide such a waterbed pedestal in which the safe is secured in the pedestal with anti-tamper means that resists the removal of the safe. It is also an object of at least some embodiments of the present invention to provide such a waterbed pedestal with an alarm that is triggered when the safe is exposed.

Generally, the waterbed pedestal of the present invention is of the type adapted to support a frame and a waterbed mattress on its top surface, and comprises a plurality of panels assembled to form head, foot, and left and right faces. A cavity is formed in the pedestal in position to extend underneath a waterbed mattress supported on the pedestal, so that the mattress covers the top of the cavity. The cavity opens at its front in one of the faces of the pedestal, and includes a back wall and opposing side walls. A safe is secured in the cavity. A removable panel is positioned over the front of the cavity to close the cavity and hide the safe.

In the preferred embodiment, the removable panel is recessed with respect to the pedestal panel that the cavity opens in. The removable panel preferably includes at least one shelf on its exterior side to disguise the fact that it is removable. The pedestal preferably includes means for triggering an alarm if the removable panel is removed. A door may be hingedly mounted to the pedestal over the removable panel. The means for securing the safe preferably includes anti-theft means for securing the safe to at least one of the sides or the back of the cavity. This anti-theft means can include flanges extending from the safe and secured with fasteners positioned to be inaccessible from the cavity side, or with fasteners that have tamper-resistent heads, so that the safe cannot be removed from the cavity side of the safe.

The waterbed pedestal of the present invention thus provides a safe for the storage and protection of valuables, taking advantage of the overlying waterbed mattress. The overlying mattress covers and protects the safe, and because of its weight, anchors the safe. The anti-theft mounting used in at least some of the embodiments resists removal of the safe from the inside side of the cavity and cooperates with the mattress which restricts access to the outside side of the cavity. The pedestal provides protection for valuables and eliminates the need for a permanently installed safe. This is a particular advantage to apartment dwellers, who usually don't have the option of installing a more permanent safe.

The removable panel hides the safe, enhancing the appearance of the pedestal, and improving security. Means may also be provided for triggering an alarm when the removable panel is removed, to scare intruders and limit the time available for intruder to try to open or remove the safe. One or more shelves may be provided on the removable panel to further enhance the appearance of the pedestal and disguise the fact that the panel is removable. Other objects and features will be in part apparent and in part pointed out hereinafter.

BRIEF DESCRIPTION OF THE DRAWINGS

Corresponding reference numerals indicate corresponding parts throughout the several Figures of the drawings.

DETAILED DESCRIPTION OF THE PREFERRED EMBODIMENTS

Figure 1:
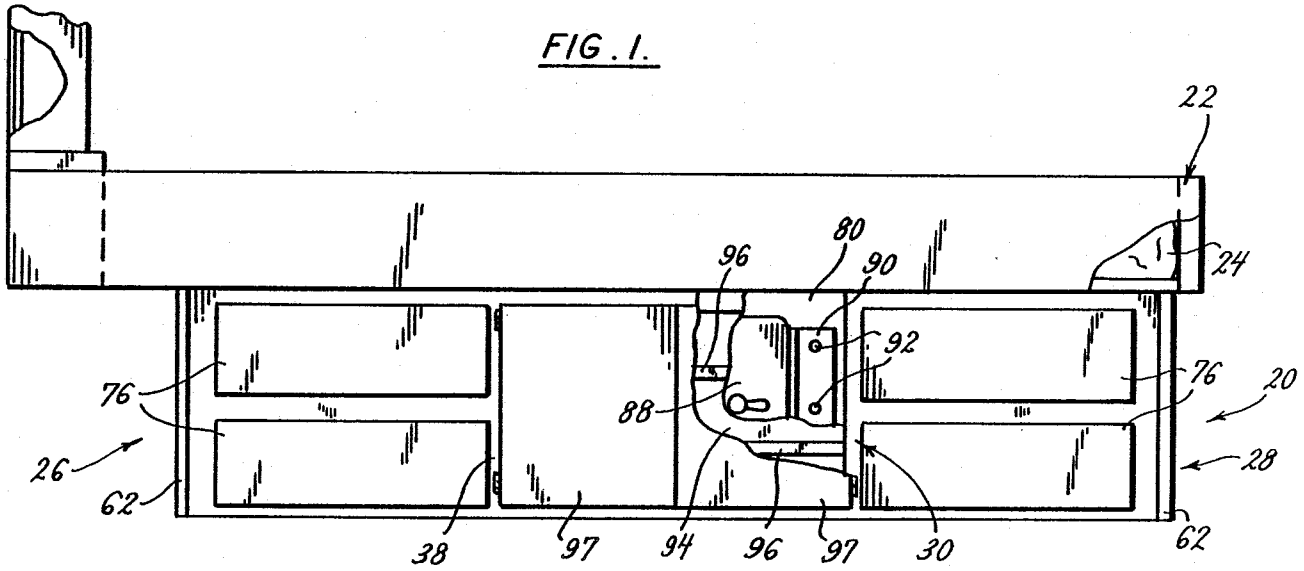
FIG. 1 is a left side elevation view of a first embodiment of a waterbed pedestal constructed according to the principles of this invention, with a waterbed frame and mattress mounted thereon, and with portions broken away to show the details of construction.
Figure 3:
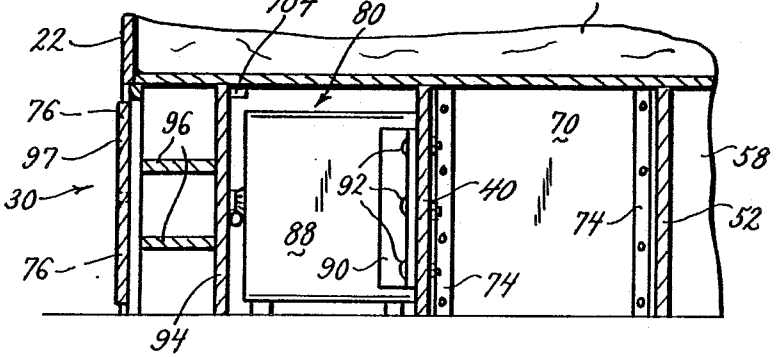
FIG. 3 a partial cross-section view of the first embodiment, taken along the plane of line 3—3 in FIG. 2.
Figure 2:
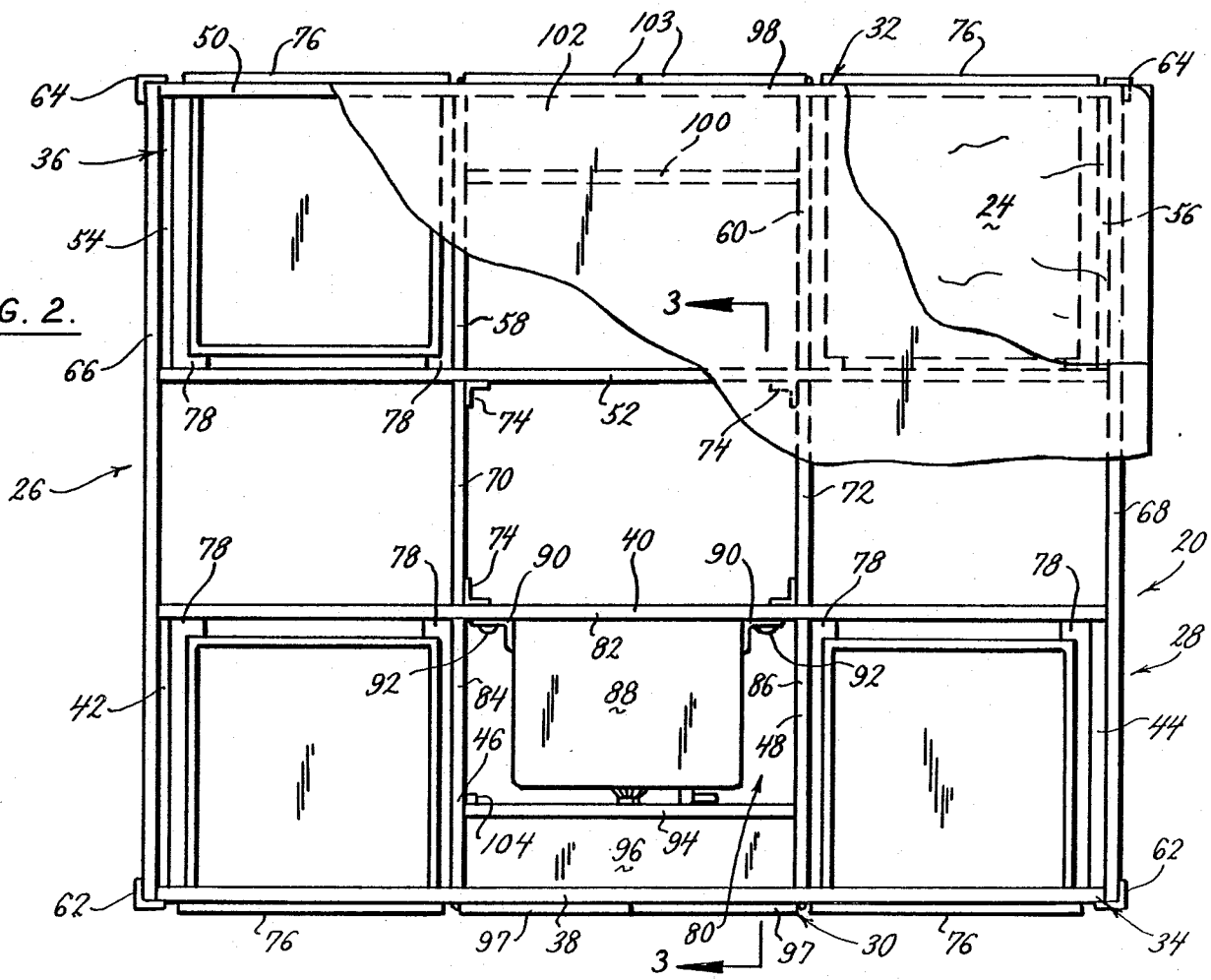
FIG. 2 is a top plan view of the first embodiment, with portions of the waterbed frame and mattress broken away to show details of construction.

A first embodiment of a waterbed pedestal constructed according to the principles of this invention, indicated generally as 20, is shown in FIGS. 1–3 as it would support a waterbed frame 22 and a waterbed mattress 24.

The pedestal 20 generally comprises a plurality of panels forming the head 26, foot 28, and left and right side faces 30 and 32, respectively, of the pedestal. As best shown in FIG. 2, pedestal 20 comprises two elongate boxes 34 and 36 arranged in parallel, but spaced apart from each other. The box 34 has a front panel 38 corresponding to the left face 30 of the pedestal, a back panel 40, and end panels 42 and 44. Bulkheads 46 and 48, which divide the box 34 generally into thirds, may be provided to strengthen the box. The box 36 is similar to the box 34, and has a front panel 50 forming the right face 32 of the pedestal, a back panel 52 and end panels 54 and 56. Bulkheads 58 and 60, which divide the box 36 generally into thirds, may be provided to strengthen the box.

An L-shaped bracket 62 is positioned at the corner of the front panel 38 and each of the end panels 42 and 44, and an L-shaped bracket 64 is positioned at the corner of the front panel 50 and the end panels 54 and 56. Each of the brackets 62 and 64 is spaced from the end panel of its respective box to form a space for receiving a panel forming the head or foot of the pedestal. Thus with the ends of the boxes 34 and 36 aligned, a panel 66 can be slid into the brackets 62 and 64 to form the head face 26 of the pedestal, and a panel 68 can be slid into the brackets 62 and 64 at the opposite ends to form the foot face of the pedestal. Cross-members 70 and 72 can be installed between the back panels 40 and 52 and secured with L-shaped brackets 74.

The end sections of each box are provided with drawer 76, which extend through the front panels 38 and 50 of the boxes and are slidably supported on gliders 78. Of course, some other type of cabinet or shelving could be provided if desired.

The pedestal 20 defines a cavity 80, that is positioned to extend underneath the water bed mattress 24 supported on the pedestal so that the mattress 24 covers the top of the cavity 80. The cavity 80 opens at its front in one of the faces of the pedestal. In the first preferred embodiment cavity 80 opens in panel 38 forming left side face 30. The cavity includes a back wall 82 formed by panel 40, and opposing side wall 84 and 86 formed by bulkheads 46 and 48.

A safe 88 is positioned in the cavity 80, and is secured therein. The safe 88 may have a two laterally extending side flanges 90, and the safe is secured with fasteners 92 extending through the flanges 90 into the back back wall 82. The fasteners 92 have anti-tamper heads that make it difficult to release the safe from the inside side of the cavity. The heavy water-filled mattress 24 blocks access to the outside side of the cavity 80, and thus it is difficult for an intruder to remove the safe 88 from the pedestal 20.

A removable panel 94 is positioned over the front of the cavity 80, to close the cavity 80 and hide the safe 88 from view. The removable panel 94 is recessed with respect to the pedestal panel 38 that the cavity 80 opens in. The removable panel 94 preferably includes at least one shelf 96 on its exterior side to disguise the fact that the panel is removable. A pair of doors 97 may be hingedly mounted over the panel 94 and shelves 96.

The panel 50 forming the right face of the pedestal preferably also has an opening 98 therein, and a panel 100 having shelves 102 thereon is secured in the opening 98. The panel 100 and shelves 102 are similar in appearance and position to the removable panel 94. This enhances the appearance of the pedestal, and further disguises the fact that removable panel 94 is removable. A pair of doors 103 similar to doors 97, may be hingedly mounted over panel 100 and shelves 102.

A switch or other suitable means 104 may be provided to trigger an alarm when the doors 97 or the removable panel 94 is removed. The alarm not only scares off intruders, but limits the amount of time the intruder has to try to open the safe or remove the safe from the pedestal 20.

Figure 4:
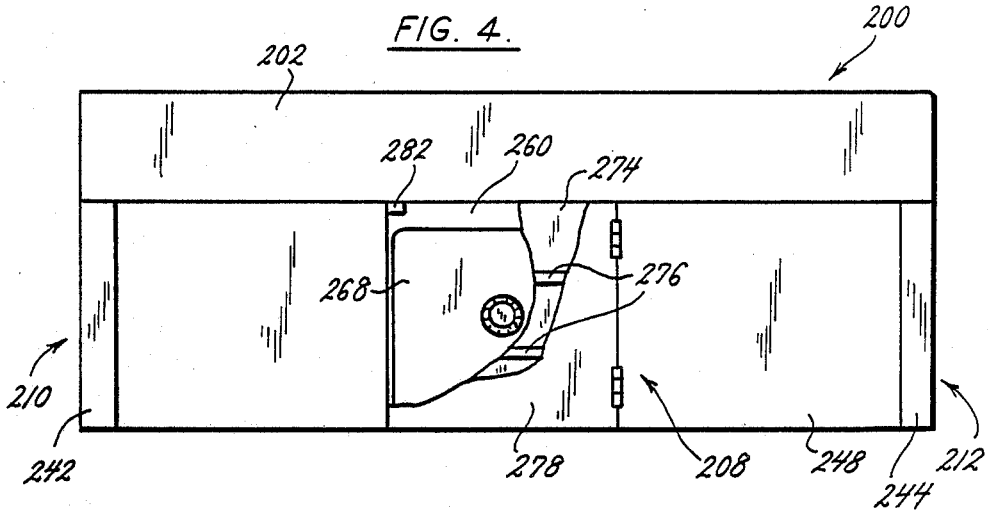
FIG. 4 is an end elevation view of a second embodiment of a waterbed pedestal constructed according to the principles of this invention, with a waterbed frame and mattress mounted thereon, and with portions broken away to show the details of construction.
Figure 6:
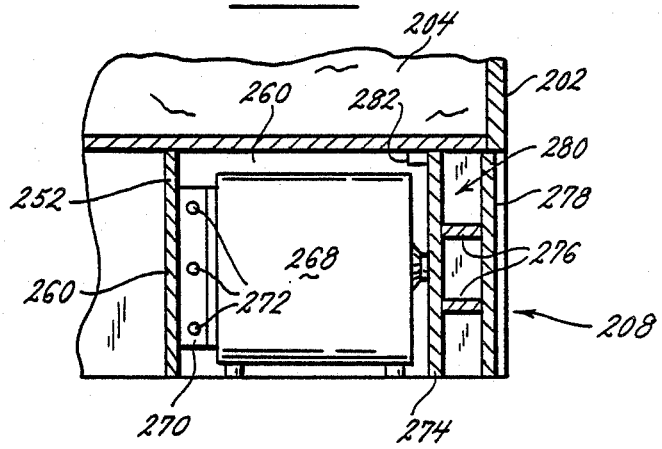
FIG. 6 is a partial cross-sectional view of the second embodiment, taken along the plane of line 6—6 in FIG. 5.
Figure 5:
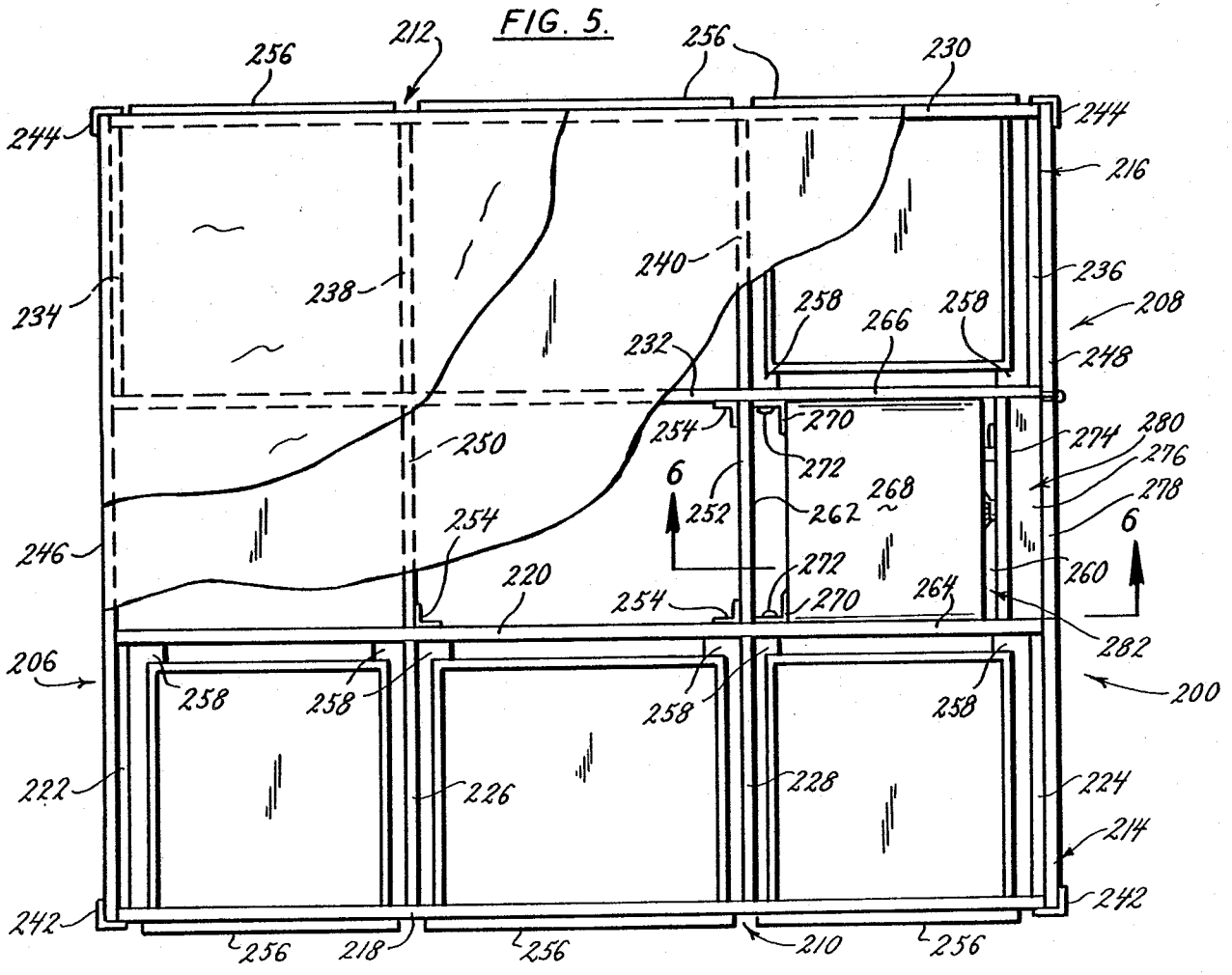
FIG. 5 a top plan view of the second embodiment, with portions of the waterbed frame and mattress broken away to show details of construction.

A second embodiment of a waterbed pedestal constructed according to the principles of this invention, indicated generally as 200, is shown in FIGS. 4–6 as it would support a waterbed frame 202 and a waterbed mattress 204.

The pedestal 200 generally comprises a plurality of panels forming the head 206, foot 208, and left and right side faces 210 and 212, respectively, of the pedestal. As best shown in FIG. 5, pedestal 200 comprises two elongate boxes 214 and 216 arranged in parallel, but spaced apart from each other. The box 214 has a front panel 218 corresponding to the left face 210 of the pedestal, a back panel 220, and end panels 222 and 224. Bulkheads 226 and 228, which divide the box 214 generally into thirds, may be provided to strengthen the box. The box 216 is similar to the box 214, and has a front panel 230 forming the right face 212 of the pedestal, a back panel 232 and end panels 234 and 236. Bulkheads 238 and 240, which divide the box 216 generally into thirds, may be provided to strengthen the box.

An L-shaped bracket 242 is positioned at the corner of the front panel 218 and each of the end panels 222 and 224, and an L-shaped bracket 244 is positioned at the corner of the front panel 230 and the end panels 234 and 236. Each of the brackets 242 and 244 is spaced from the end panel of its respective box to form a space for receiving a panel forming the head or foot of the pedestal. Thus with the ends of the boxes 214 and 216 aligned, a panel 246 can be slid into the brackets 242 and 244 to form the head face 206 of the pedestal, and a panel 248 can be slid into the brackets 242 and 244 at the opposite ends to form the foot face of the pedestal. Cross-members 250 and 252 can be installed between the back panels 220 and 232 and secured with L-shaped brackets 254.

The sections of each box are provided with a drawers 256, which extend through the front panels 218 and 230 of the boxes and are slideably supported on gliders 258. Of course some other type of cabinet or shelving could be provided if desired.

The pedestal 200 defines a cavity 260, that is positioned to extend underneath water bed mattress 204 supported on the pedestal so that the mattress 204 covers the top of the cavity 260. The cavity 260 opens at its front in one of the faces of the pedestal in the second preferred embodiment it opens in the panel 248 forming the foot face 208. The cavity includes a back wall 262 formed by the cross member 252, and opposing side walls 264 and 266 formed by the back walls 220 and 232 of the boxes 214 and 216.

A safe 268 is positioned in the cavity 260, and is secured therein. The safe 268 may have a two rearwardly extending side flanges 270, and the safe is secured with fasteners 272 extending through the flanges 270 into the side walls 264 and 266. The fasteners 272 may have antitamper heads. However, this is not essential because the safe 268 itself blocks access to the fasteners 272 making it difficult to release the safe from the inside side of the cavity. The heavy water-filled mattress blocks access to the outside side of the cavity 260, and thus it is difficult for an intruder to remove the safe 268 from the pedestal 200.

A removable panel 274 is positioned over the front of the cavity 260, to close the cavity 260 and hide the safe 268 from view. The removable panel 274 is recessed with respect to the pedestal panel 248 that the cavity 260 opens in. The removable panel 274 preferably includes at least one shelf 276 on its exterior side to disguise the fact that the panel is removable. A door 278 is preferably hingedly mounted to the pedestal 200 over the removable panel 274. This enhances the appearance of the pedestal 200 and defines a closed compartment 280 in front of the removable panel 274 that further disguises the fact that panel 274 is removable. A switch or other suitable means 282 may be provided to trigger an alarm when the removable panel is removed. The alarm not only scares off intruders, but limits the amount of time the intruder has to try to open the safe or remove the safe from the pedestal 200.

OPERATION

The waterbed pedestal of either embodiment is assembled and the safe 88 or 268 installed. Either embodiment provides for the storage and protection of valuables in the home, without the need for a permanently installed safe. The waterbed frame 22 or 202 is assembled over its respective pedestal, and the waterbed mattress 24 or 204 is filled. The filled waterbed mattress, which typically weighs about 1000 pounds, covers the entire top of the cavity 80 or 260 in which the safe is installed.

In either embodiment the safe is hidden behind a removable panel 94 or 274, and thus is difficult for an intruder to locate. The removable panel preferably has at least one shelf 96 or 276 on the outside surface thereof to further disguise the removability of panel. Doors 97 may be provided over the panel 94 and door 278 may be provided over the panel 276, to further disguise the fact that the panels are removable.

Even if the safe is discovered, the removal of the opening of the doors 97 or 278 triggers switches 104 and 282, respectively, which trigger an alarm that would scare off most intruders or limit the time available to the intruder to try to open the safe or to remove the safe from its pedestal before authorities arrive. Removing the safe 88 is made difficult by the use of tamper-resistent fasteners 94. The heads resist the removal of the safe from the inside side of the cavity 80, and the mattress blocks access to the outside side of the cavity. Removing safe 268 is made difficult because access to the fasteners 274 on the inside side of the cavity is blocked by the safe 268. Access to the outside side of the cavity is blocked by the mattress 204. In addition, the fasteners 274 may be tamper resistant fasteners, if desired. Thus the pedestal provides for convenient storage and protection of valuables.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. An improved waterbed pedestal for supporting a waterbed frame and mattress on its top surface, the pedestal of the type comprising a plurality of panels assembled to form head, foot, and left and right side faces, the improvement comprising:

means for defining a cavity in the pedestal positioned to extend underneath a waterbed mattress supported on the pedestal so that the mattress covers the top of the cavity, the cavity opening at its front in one of the faces of the pedestal and including a back wall and opposing side walls;

Safe positioned in the cavity;

attachment means for securing the safe in the cavity by attachment to at least one of the sides or back of the cavity; and a removable panel adapted to be positioned over the front of the cavity to close he cavity and hide the safe.

2. The improved waterbed pedestal according to claim 1 wherein the removable panel is recessed with respect to the pedestal panel that the cavity opens in.

3. The improved waterbed pedestal according to claim 2 wherein the removable panel includes at least one shelf on its exterior side to disguise the fact that it is removable.

4. The improved waterbed pedestal according to claim 3 further comprising a door hingedly mounted to the pedestal, over the removable panel.

5. The improved waterbed pedestal according to claim 3 wherein the cavity opens in the foot of the pedestal, and further comprising a door hingedly mounted to the pedestal panel over the removable panel.

6. The improved waterbed pedestal according to claim 1 wherein the cavity opens in one of the sides of the pedestal and wherein the opposite side of the pedestal includes a recessed panel similar in appearance and position to the removable panel.

7. The improved waterbed pedestal according to claim 1 further comprising means for triggering an alarm when the removable panel is removed from the cavity.

8. The improved waterbed pedestal according to claim 1 wherein the means for securing the safe comprises anti-theft means said anti-theft means resisting the release of the safe from the cavity side.

9. The improved waterbed pedestal according to claim 8 wherein the anti-theft means for securing the safe in the cavity includes flanges extending laterally from the safe, and fasteners with tamper-resistent heads securing the flanges to the back of the cavity.

10. The improved waterbed pedestal according to claim 8 wherein the anti-theft means for securing the safe in the cavity includes flanges extending rearwardly from the safe and fasteners securing the flanges to the sides of the cavity, the safe blocking access to the fasteners from the cavity.

11. An improved waterbed pedestal for supporting a waterbed frame and mattress on its top surface, the pedestal of the type comprising a plurality of panels assembled to form head, foot, and left and right side faces, the improvement comprising:

means for defining a cavity in the pedestal positioned to extend underneath a waterbed mattress supported on the pedestal so that the mattress covers the top of the cavity, the cavity opening at its front in one of the faces of the pedestal and including a back wall and opposing side walls;

a safe positioned in the cavity;

anti-theft means for securing the safe by attachment to at least one of the sides or back of the cavity, said antitheft means resisting the release of the safe from the cavity side; and a removable panel adapted to be positioned over the front of the cavity to close the cavity and hide the safe.

12. The improved waterbed pedestal according to claim 11 further comprising means for triggering an alarm when the removable panel is removed from the cavity.

13. The improved waterbed pedestal according to claim 11 wherein the removable panel is recessed with respect to the pedestal panel that the cavity opens in.

14. The improved waterbed pedestal according to claim 13, wherein the removable panel includes at least one shelf on its exterior side to disguise the fact that it is removable.

15. The improved waterbed pedestal according to claim 14 further comprising a door hingedly mounted to the pedestal, over the removable panel.

16. The improved waterbed pedestal according to claim 14 wherein the cavity opens in one of the sides of the pedestal and wherein the opposite side of the pedestal includes a recessed panel similar in appearance and position to the removable panel.

17. The improved waterbed pedestal according to claim 13 wherein the cavity opens in the foot of the pedestal, and further comprising a door hingedly mounted to the pedestal panel over the removable panel.

18. The improved waterbed pedestal according to claim 11 wherein the anti-theft means for securing the safe in the cavity includes flanges extending laterally from the safe, and fasteners with tamper-resistent heads securing the flanges to the back of the cavity.

19. The improved waterbed pedestal according to claim 11 wherein the anti-theft means for securing the safe in the cavity includes flanges extending rearwardly from the safe and fasteners securing the flanges to the sides of the cavity, the safe blocking access to the fasteners from the cavity.

* * * * *